US005580191A

United States Patent [19]

Egan

[11] Patent Number: 5,580,191

[45] Date of Patent: Dec. 3, 1996

[54] MARINE WALL

[75] Inventor: Philip D. Egan, Atlanta, Ga.

[73] Assignee: The Tensar Corporation, Atlanta, Ga.

[21] Appl. No.: 384,938

[22] Filed: Feb. 7, 1995

[51] Int. Cl.[6] ..... E02D 29/02

[52] U.S. Cl. ..... 405/262; 405/284

[58] Field of Search ..... 405/258, 262, 405/282, 284

[56] References Cited

U.S. PATENT DOCUMENTS

| | | | |
|---|---|---|---|
| 3,728,862 | 4/1973 | Meredith | 405/285 |
| 3,999,391 | 12/1976 | Meredith | 405/259.5 |
| 4,440,527 | 4/1984 | Vidal . | |
| 4,674,921 | 6/1987 | Berger . | |
| 4,690,588 | 9/1987 | Berger . | |
| 5,145,287 | 9/1992 | Hooper et al. . | |
| 5,163,261 | 11/1992 | O'Neill | 405/284 |
| 5,257,880 | 11/1993 | Janopaul, Jr. | 405/284 |
| 5,419,659 | 5/1995 | Mercer | 405/284 X |
| 5,484,235 | 1/1996 | Hilfiker et al. | 405/284 |

*Primary Examiner*—William P. Neuder
*Attorney, Agent, or Firm*—Jacobson, Price, Holman & Stern, PLLC

[57] ABSTRACT

A retaining wall, preferably for marine use, constructed of a plurality of corrugated panels. The corrugated panels of the wall are anchored in the earth behind the wall by a plurality of vertically spaced, horizontally extending lengths of sections of geogrid material. Geogrid sections are secured to the wall made up of a plurality of corrugated panels by walers secured to the wall. One waler is positioned on an exterior surface of the wall. An upper interior waler section and a lower interior waler section are positioned on an interior surface of the wall. In the lowermost surface of the upper interior waler section and the uppermost surface of the lower interior waler section is a grooved recess. A comb connector made of a central spine and upwardly and downwardly projecting fingers interconnects the upper and the lower interior waler sections by extending downwardly into the groove of the lower interior waler section and upwardly into the groove of the upper interior waler section. The longitudinally extending strands of the geogrid sections, whether of biaxial or uniaxial construction, are held in place between the upper and lower interior waler sections, between the downwardly extending teeth and the spine of the comb.

33 Claims, 3 Drawing Sheets

MARINE WALL

FIELD OF THE INVENTION

This invention relates to the field of retaining walls made of corrugated wall panels, particularly adapted for marine use, with strips of geogrid material extending rearwardly therefrom to anchor the wall in a fill material.

BACKGROUND OF THE INVENTION

The problem of land erosion adjacent to waterways such as rivers, streams, lakes and oceans, has traditionally been combatted by the use of wood, steel or cement construction. Efforts to limit erosion along these waterways have also included the use of a series of bulkhead strips made from a plastic material.

One such system is described in U.S. Pat. Nos. 4,674,921 and 4,690,588 to Berger and marketed by C-Loc® Retention Systems, Inc. of Utica, Mich. incorporated herein in their entirety by reference. This system includes a series of interlocking corrugated bulkhead strips, which are interconnected to form a barrier of heavy duty, exterior grade polyvinyl chloride (PVC). Each strip includes a male and female shaped edge and is lifted and slid into interengagement within an adjacent strip and manually driven into the ground. To assist in reinforcing and shoring up of the assembled seawall, an anchoring system is embedded in the ground.

The anchoring system includes a plurality of laterally spaced elongated, corrugated anchor strips, preferably constructed of PVC, which are embedded in the ground at an acute angle to the seawall. The spaced anchor strips, referred to as dead man strips, are inclined upwardly and outwardly with respect to the seawall and are connected thereto by a series of horizontally disposed and laterally spaced tie rods or tie backs. The corrugated anchor strips include transversely extending walers. Each waler is hollow, preferably rectangular in cross section, flexible, and made of a plastic material, such as PVC. The tie rods have threaded ends which extend through the corresponding anchor strip and the opposed adjacent bulkhead strip. Walers are mounted on opposite ends of the rod and secured thereto by flat washers and nuts.

The walers are resilient for transferring and distributing the forces applied to the seawall from an individual corrugated strip or plurality thereof, back to the corresponding opposed anchor strips. If the distance the seawall extends above the water level is considerable, it is contemplated that a second set of laterally spaced tie rods will be employed, vertically aligned with corresponding tie rods for reinforcement of the seawall along its length.

Another system using a plastic panel erosion barrier wall is disclosed in U.S. Pat. No. 5,145,287 to Hooper et al and distributed under the name ShoreGuard™ Vinyl Seawall by Materials International, Inc. of Atlanta, Ga. also incorporated herein in its entirety by reference. In this patent a corrugated plastic panel strip is described with opposed male and female interlocking edges provided for mating association with adjacent panel strips.

To assist in securing the position of the formed wall, a concrete anchor is provided a distance back from the wall and embedded below the ground level. A tie rod holds the wall in place by being connected to a reinforcing rod embedded in the cement cap of the wall and extending back to a reinforcing rod similarly embedded in the concrete anchor. The tie rod is connected between the two reinforcing rods in the concrete wall cap and the concrete anchor by bending the ends of the tie rod about the reinforcing rods.

In a seawall having a sufficient height, an additional lower level of tie rods are used to interconnect the strips of the seawall with a concrete anchor which is also connected to the concrete cap of the seawall by a second set of tie rods. The tie rods connected below the level of the tie rods connected to the cap impart a greater strength to a deep wall. The lower set of tie rods extend through the panel strip of the seawall and through a waler positioned on the exterior surface of the seawall, while the tie rods are provided at spaced distances along the length of the wall depending upon the strength to be imparted and required to hold the waler in place.

SUMMARY OF THE INVENTION

By the present invention, a retaining wall, preferably for marine use, is constructed of a plurality of corrugated wall panels such as those disclosed in U.S. Pat. Nos. 4,674,921 and 4,690,588, or U.S. Pat. No. 5,145,287. According to a preferred embodiment of the present invention, the corrugated panels of the wall are anchored in the fill material behind the wall by a plurality of vertically spaced, horizontally extending lengths of sections of reinforcing material, preferably integral geogrid material manufactured by The Tensar Corporation of Atlanta, Ga. in accordance with the disclosure of Mercer U.S. Pat. No. 4,374,798, herein incorporated in its entirety by reference. Each geogrid section includes a plurality of longitudinally extending strands interconnected by a transverse bar in the case of a uniaxially stretched geogrid. In a biaxially stretched geogrid, strands extend longitudinally and transversely, interconnected by node portions.

Geogrid sections are secured to the wall made up of a plurality of corrugated panels by an exterior waler, positioned on an exterior surface of the wall, and two interior waler sections, positioned on an interior surface of the wall. The walers are preferably made of wood or recycled plastic material. The exterior waler effectively provides a distribution of the forces acting between the exterior waler and the two inner waler sections. It is considered as being within the scope of the present invention to provide other means for anchoring the interior waler sections to the corrugated panels of the wall by other than the use of an exterior waler.

It is considered as being part of the present invention to provide the interior waler sections of a straight configuration so as to engage peaks of the peaks and valleys of the corrugated panels. The interior waler sections thereby effectively provide a mechanism for securing the terminal ends of sections of reinforcing material to the corrugated panels of the wall rather than having to contend with the undulating pattern of the corrugated panels to which it would otherwise be difficult to secure the reinforcing material according to the present invention.

Aligned groove recesses are defined in the lowermost surface of the upper interior waler section and the uppermost surface of the lower interior waler section. A comb connector made of a central spine and upwardly and downwardly projecting fingers interconnects the upper interior waler section and the lower interior waler section by extending downwardly into the grooved recess of the lower interior waler section and upwardly into the grooved recess of the upper interior waler section. The longitudinally extending strands of the geogrid sections, whether of biaxial or uniaxial construction, are held in place between the upper and lower interior waler sections, by the downwardly extending fingers and the spine of the comb.

The fingers of the comb which extend downwardly into the lower interior waler section are serrated in a pattern of downwardly angled stepped portions which facilitate driving of the fingers of the comb into the grooved recess of the lower interior waler section and resist extraction of the downwardly extending fingers in an opposite direction. The sidewalls of the teeth of the comb extending upwardly into the upper interior waler section are smooth so as to engage and be guided into position by the walls of the grooved recess in the upper interior waler section.

Tie rods, threaded at both ends, extend through the exterior waler, the wall made of the corrugated panels and a gap between the upper and lower interior waler sections. The tie rod then passes through a steel U-shaped channel into which the upper and lower interior waler sections are fitted to hold the upper and lower interior waler sections together. The tie rods are located in the gaps between adjacent geogrid sections.

The exterior threaded end of the tie rod is secured in place on the exterior waler by a plate contacting the exterior waler with a nut threaded onto the exterior end of the tie rod. Similarly, a nut on the interior threaded end of the tie rod contacts the U-shaped channel to secure the U-shaped channel in place. Tightening of the nuts compresses the interior waler sections and exterior waler against the wall.

The tie rod, plate and nut on the exterior end of the tie rod, and the nut on the interior end of the tie rod may be made of steel or any other suitable material, although fiberglass or other non-corrosive materials are preferably used when the wall is in a marine environment to prevent discoloration or deterioration of the components of the system.

The geogrid sections secured by the interior waler extend rearwardly and substantially horizontally into the fill material to reinforce the wall by anchoring the wall to the fill material.

Accordingly, it is an object of the present invention to anchor a wall made of a plurality of corrugated panels by the use of sections of geogrid attached at a terminal end in a straight line across the corrugations of an interior surface of the corrugated panels of the wall and extending horizontally into a fill material.

It is another object of the present invention to attach a plurality of sections of geogrid to a wall made of a plurality of corrugated panels by securing the terminal ends of the geogrid to a waler extending straight across the corrugations of an interior surface of the wall.

It is yet another object of the present invention to anchor a wall made of a plurality of corrugated panels by securing the terminal ends of sections of geogrid between upper and lower waler sections extending straight across the corrugations at an interior surface of the wall, with a retention device securing the terminal ends of the geogrid sections to the interior waler sections.

It is still yet another object of the present invention to produce a wall of a plurality of corrugated panels having a waler extending across an exterior surface of the wall connected to waler sections extending straight across corrugations of the interior surface of the wall with the interior waler sections securing a plurality of terminal ends of the sections of geogrid in fill material behind the wall so as to maintain the wall in position.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
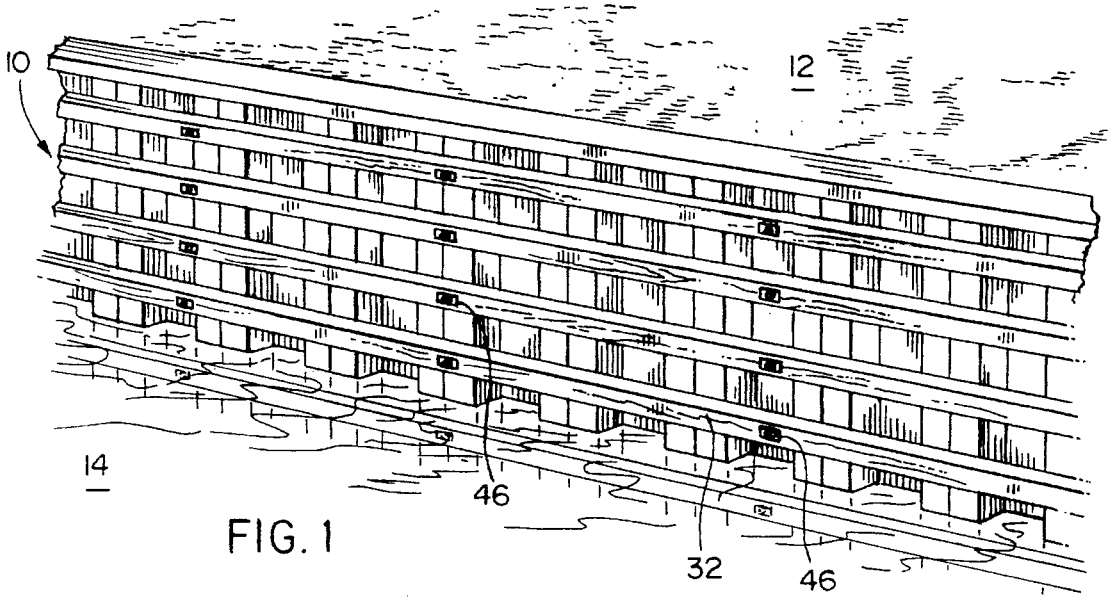
FIG. 1 shows a front perspective elevational view of a marine retaining wall or the like according to the instant invention.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
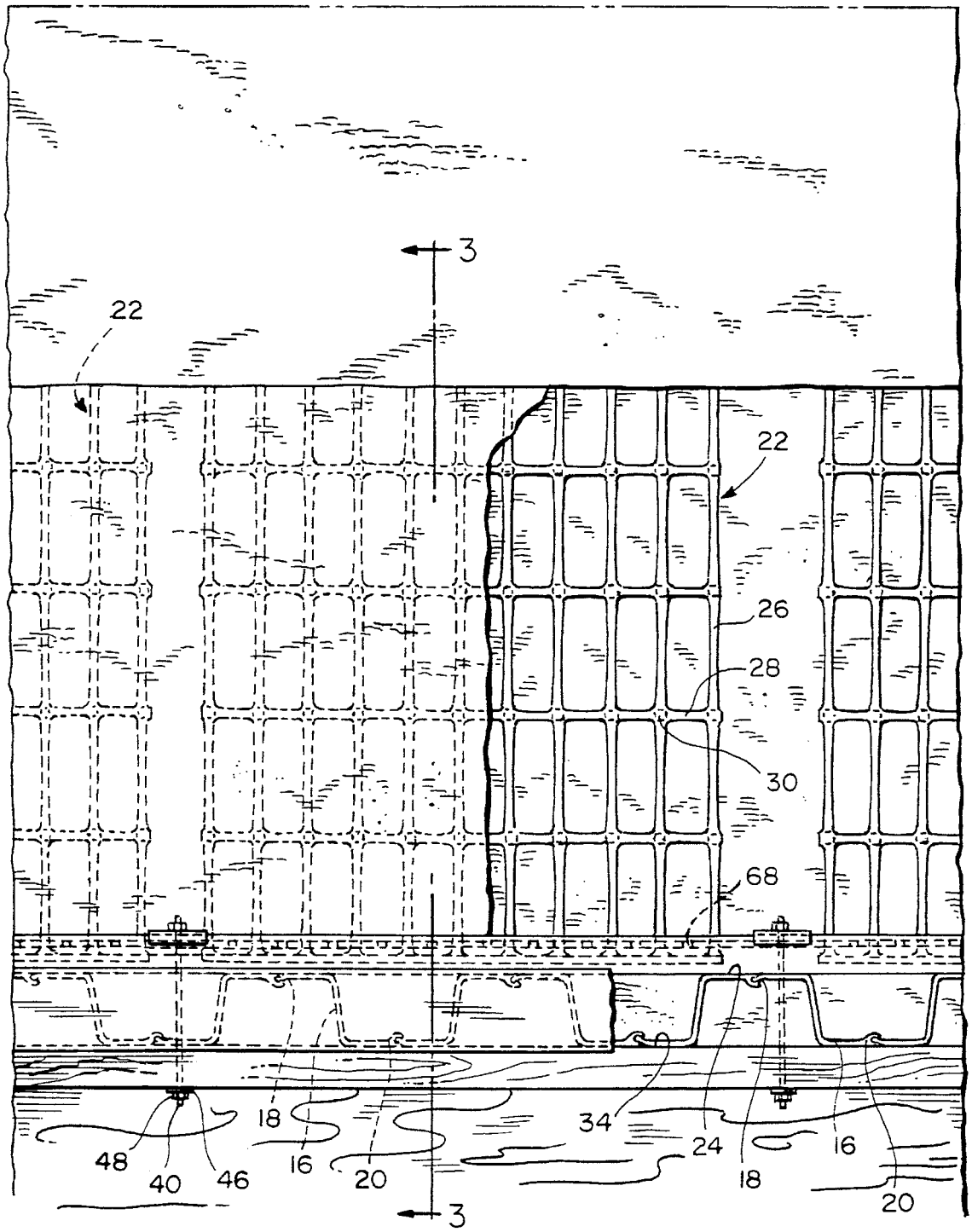
FIG. 2 is a fragmentary sectional plan view of a retaining wall according to the instant invention with parts broken away for illustrative clarity.
Figure 3:
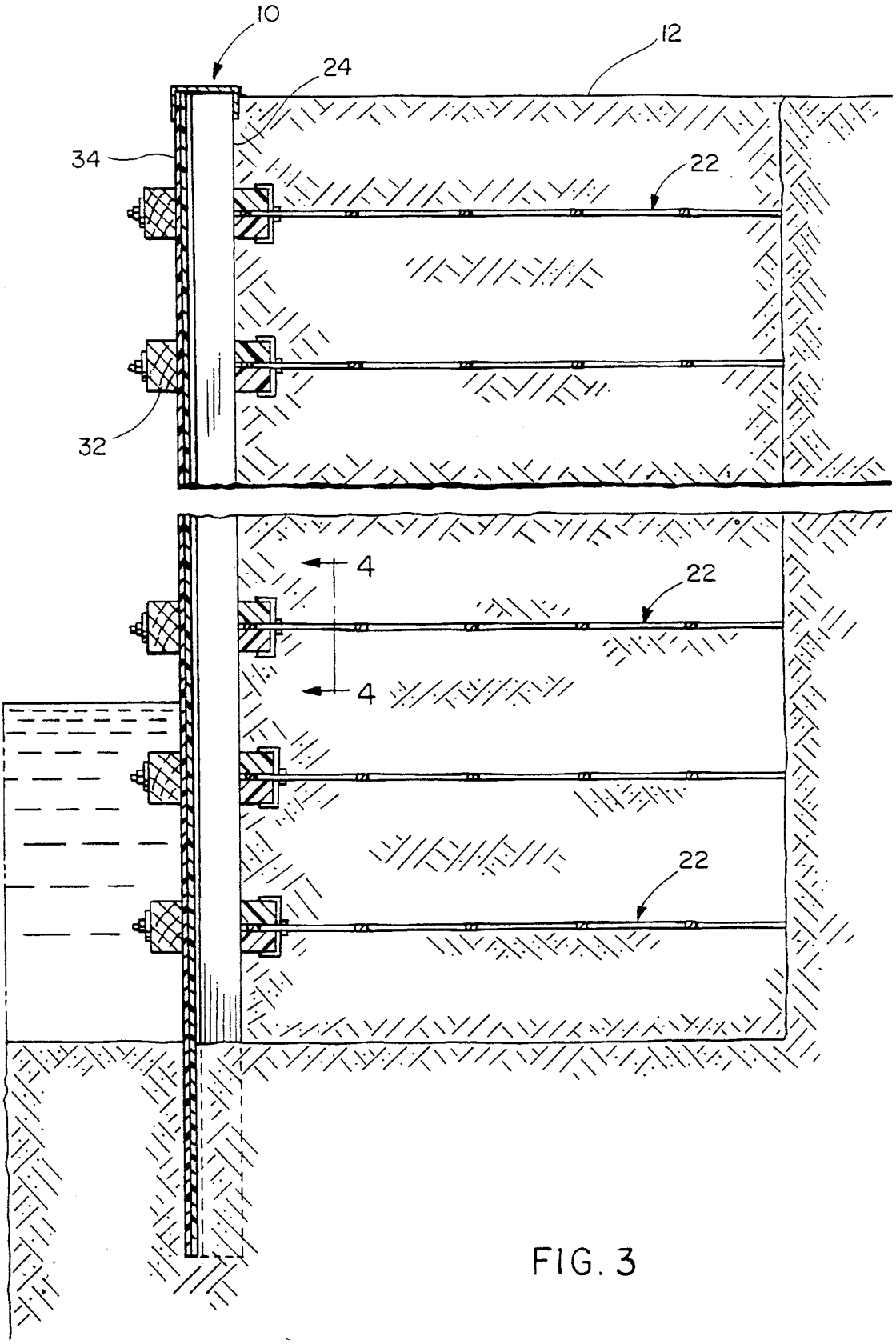
FIG. 3 is a transverse cross-sectional view of the wall taken along lines 3—3 of FIG. 2.

With reference to the drawings, in general, and to FIGS. 1 through 3, in particular, a retaining wall embodying the teachings of the present invention is generally designated as 10. In the illustration of FIG. 1, the retaining wall 10 is positioned to separate earth or fill material 12 from a body of water 14.

The wall 10 is made up of a plurality of corrugated panels 16 made of a plastic material preferably made in accordance with the disclosure of U.S. Pat. No. 5,145,287 or U.S. Pat. Nos. 4,674,921 and 4,690,588, although other retaining wall panel constructions may readily be adapted for use with the instant inventive concepts. As shown in FIG. 2, each corrugated panel 16 has an undulating pattern and includes a male side edge 18 and a female side edge 20 for interconnecting adjacent corrugated panels 16 in accordance with the practices disclosed in the patents incorporated by reference.

To anchor the wall 10, made of the plurality of corrugated panels 16, a terminal end of a plurality of sections of reinforcing material, such as geogrid 22, extend rearwardly into the fill material 12 from an interior surface 24 of the wall 10. The preferred reinforcing material comprises uniaxial or biaxial integral geogrid sections 22 made in accordance with the disclosure of U.S. Pat. No. 4,374,798. However, alternate reinforcing sheet materials may be used to anchor the retaining wall according to this invention so long as they comprise a multiplicity of spaced openings enabling engagement by the unique connector device disclosed herein. In FIG. 2, integral geogrid sections 22 are shown which include elongated strands 26 extending longitudinally and strands or bars 28 extending transversely, interconnected by nodes 30.

To facilitate the attachment of the geogrid sections 22 to corrugations of the corrugated panels 16 so that the geogrid sections extend rearwardly in a horizontal plane from the interior face 24 of the wall 10, in vertically stacked rows, as shown in FIG. 3, an exterior waler 32 or other securing device is positioned over the exterior surface 34 of the wall 10 to span a number of panels 16. The exterior waler 32 is elongated to extend across the corrugations of the exterior face 34 of the wall 10 and may be made of wood or recycled plastic.

Exterior walers 32 include holes 36 at approximately 5 foot centers which are aligned with holes 37 in the corrugated panels 16 to receive tie rods 38 therethrough. Each tie rod 38 includes an exterior threaded end 40 and an interior threaded end 42. A retaining plate 46 shown as rectangular is positioned on an exterior surface 44 of waler 34 through which tie rod 38 passes to distribute the pressure from a nut 48 threadingly engaging the exterior end 40 (or an integral head on the end 40, not shown). Plate 46 could be replaced by a washer or be of some other shape to distribute forces exerted by nut 48 by a retraction of tie rod 38.

Positioned on the interior surface 24 of the wall 10 is an upper interior waler section 54 and a lower interior waler section 56. Upper interior waler section 54 and lower interior waler section 56 include opposed grooves 58 and 60, respectively. A gap formed between the upper and lower interior waler sections 54, 56 provides for passage therethrough of interior end 42 of the tie rod 38 after a central portion 50 of the tie rod 38 passes through a portion of a corrugated panel 16.

Held between the upper and lower interior waler sections 54, 56 is a connector comb 62 for securing terminal ends of geogrid sections 22 to the interior waler sections 54 and 56. Comb 62 includes a spine 64 having downwardly extending fingers 66 and upwardly extending fingers 68. Downwardly extending fingers 66 include serrations 69 formed of horizontally extending upper surfaces 70 and downwardly extending, inwardly inclined surfaces 72. The spacing of the fingers 66 is provided to fit between the longitudinally extending strands 26 of the geogrid sections 22.

Accordingly, when the comb 62 is driven into the groove 60, the serrations 69 grip the sidewalls of groove 60 to hold the connector comb 62 in place. The geogrid sections 22 are thereby trapped by the spine 64 pressing the strands 26 towards the upper surface of the lower interior waler section 56. The groove 58 of the upper interior waler section 54 is fitted over the fingers 68 of the comb 62 to properly align the upper portion 54 with respect to the lower portion 56. The spacing between the upper and lower interior waler portions is based upon the amount that the spine 64 and fingers 68 are permitted to extend into groove 58 and the height of the strands 26 trapped between the lower interior waler section 56 and the spine 64.

Between adjacent sections 22 of geogrid, a U-shaped channel 74 is fitted around the upper interior waler section 54 and the lower interior waler section 56 with the tie rod 38 extending therethrough. A nut 74, and optionally a washer (not shown), secures the U-shaped channel 74 on the interior threaded end 42 of the tie rod 38. U-shaped channel 74 and nut 76 are made of steel or fiberglass. The two sections 54, 56 are preferably made of wood or recycled plastic.

Figure 4:
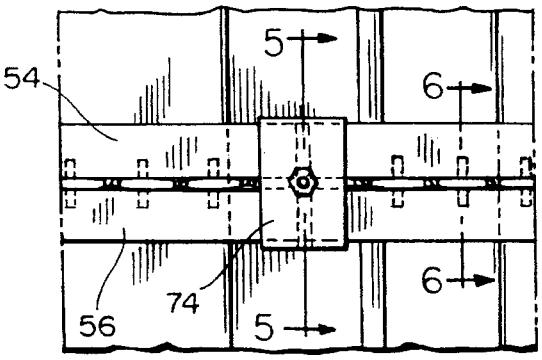
FIG. 4 is a cross-sectional view taken along lines 4—4 of FIG. 3.
Figure 5:
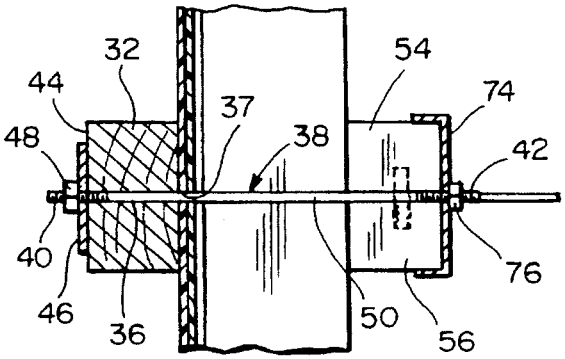
FIG. 5 is a cross-sectional view taken along lines 5—5 of FIG. 4.
Figure 6:
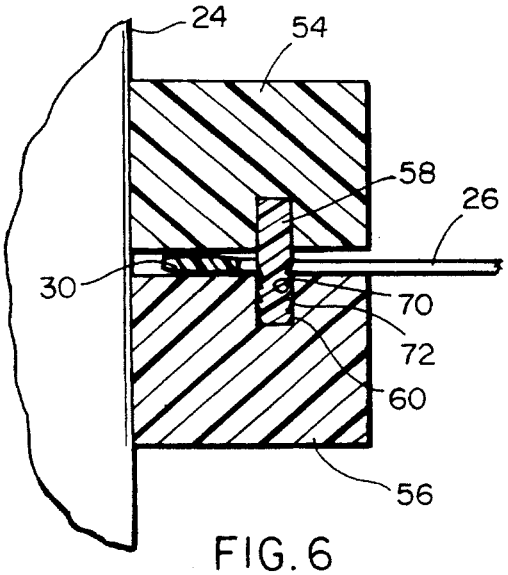
FIG. 6 is an enlarged cross-sectional detail view taken along lines 6—6 of FIG. 4, showing a comb connection between two portions of a waler and a geogrid anchor according to the instant inventive concepts.
Figure 7:
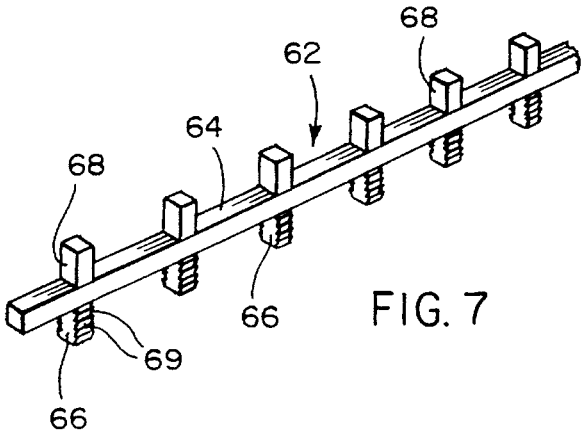
FIG. 7 is a perspective view of the comb connector.

As shown in FIG. 2 and 4, tie rod 38 extends between adjacent sections of upper and lower interior waler sections 54 and 56 and adjacent geogrid sections 22. Accordingly, interior waler sections 54 and 56 preferably have a length of approximately 4 feet, 11 inches whereas the spacing between adjacent tie bolts 38 is 5 feet on center. This would provide a separation between geogrid sections 22 having a width of approximately 4.25 feet, with a separation distance between adjacent sections 22 of geogrid of approximately 9 inches.

By the present invention a plurality of layers of geogrid sections, as shown in FIG. 3, extend into fill material 12 from interior surface 24 to reinforce the wall 10. The use of the connector system of the present invention provides a connection of the terminal ends of the geogrid sections by straight interior waler sections so as to span the corrugations on the interior surface of the corrugated panels. This provides a quickly assembled, lightweight reinforcement for the wall 10 using sections of geogrid which would otherwise be difficult to attach to the corrugated panels.

Having described the invention, many modifications thereto will become apparent to those skilled in the art to which it pertains without deviation from the spirit of the invention as defined by the scope of the appended claims.

What is claimed is:

1. A retaining wall comprising:

a generally vertically extending wall defined by a plurality of corrugated wall panels each having an exterior face, an interior face and vertically extending side edge portions, said panels being interconnected at laterally juxtaposed side edge portions, at least one interior waler juxtaposed to said interior faces of said wall panels, and elongated reinforcing strip material having one end secured to said interior waler and extending generally horizontally and rearwardly therefrom and embedded in a fill material behind said interior faces.

2. A retaining wall as claimed in claim 1, wherein said reinforcing strip material comprises a plurality of sections of geogrid having end portions secured to said interior faces of said wall panels.

3. A retaining wall as claimed in claim 1, wherein said wall panels include interior and exterior faces each of which defines crest portions and valley portions, said interior waler is juxtaposed to said crest portions of said interior faces of said wall panels, said reinforcing strip material having end portions secured to said interior waler.

4. A retaining wall as claimed in claim 3, wherein said interior waler is divided into two sections, said end portions of said reinforcing strip material being held between said two sections of said interior waler.

5. A retaining wall as claimed in claim 4, further including a connector comb securing said reinforcing strip material to both sections of said interior waler.

6. A retaining wall as claimed in claim 5, wherein a lower one of said two sections of said interior waler includes an upwardly opening groove, said connector comb including a plurality of spaced downwardly extending teeth interconnected by a continuous spine, said reinforcing strip material including a plurality of spaced openings juxtaposed to said end portions, said downwardly extending teeth of said connector comb extending through said openings and into said groove to secure said reinforcing strip material to said interior waler.

7. A retaining wall as claimed in claim 6, wherein said downwardly extending teeth are serrated.

8. A retaining wall as claimed in claim 7, wherein an upper one of said two sections of said interior waler includes a downwardly opening groove, said connector comb further including a plurality of teeth extending upwardly into said downwardly opening groove.

9. A retaining wall as claimed in claim 4, wherein said two portions of said interior waler are held together by a U-shaped channel.

10. A retaining wall as claimed in claim 3, further including an exterior waler juxtaposed to said exterior faces of said wall panels and a connector securing said interior waler, said wall panels and said exterior wall to each other.

11. A retaining wall as claimed in claim 10, wherein said interior waler is secured to said exterior waler by a tie rod.

12. A retaining wall for retaining a fill material, said retaining wall comprising:

a generally vertically extending wall defined by a plurality of interconnected elongated, corrugated wall panels each having an exterior face, an interior face and vertically extending side edge portions, said panels being interconnected at laterally juxtaposed side edge portions, a plurality of interior walers juxtaposed to said interior faces of said wall panels, a plurality of geogrid sections secured at one end to said interior walers, said plurality of geogrid sections extending rearwardly and engaging said fill material and anchoring said plurality of interconnected elongated panels, and means for securing said geogrid sections to said interior waler.

13. A retaining wall as claimed in claim 12, wherein said wall panels include interior and exterior faces each of which defines crest portions and valley portions, wherein said means includes said interior waler juxtaposed to said crest portions of said interior faces of said wall panels and holding end portions of said geogrid sections.

14. A retaining wall as claimed in claim 13, wherein said interior waler extends substantially straight across said wall panels.

15. A retaining wall as claimed in claim 12, wherein said geogrid sections extend substantially horizontally.

16. A retaining wall as claimed in claim 14, wherein said interior waler includes an upper section and a lower section with said geogrid sections held therebetween.

17. A retaining wall as claimed in claim 16, wherein a connector comb secures said geogrid sections between said two portions.

18. A retaining wall as claimed in claim 17, wherein a lower one of said two sections of said interior waler includes an upwardly opening groove, said connector comb including a plurality of spaced downwardly extending teeth interconnected by a continuous spine, said reinforcing strip material including a plurality of spaced openings juxtaposed to said end portions, said downwardly extending teeth of said connector comb extending through said openings and into said groove to secure said reinforcing strip material to said interior waler.

19. A retaining wall as claimed in claim 18, wherein said downwardly extending teeth are serrated.

20. A retaining wall as claimed in claim 19, wherein an upper one of said two sections of said interior waler includes a downwardly opening groove, said connector comb further including a plurality of teeth extending upwardly into said downwardly opening groove.

21. A retaining wall as claimed in claim 16, wherein said two portions of said interior waler are held together by a U-shaped channel.

22. A retaining wall as claimed in claim 12, further including an exterior waler juxtaposed to said exterior faces of said wall panels and a connector securing said interior waler, said wall panels and said exterior wall to each other.

23. A retaining wall comprising:

a generally vertically extending wall defined by a plurality of corrugated wall panels each having an exterior face, an exterior face and vertically extending side edge portions, said panels being interconnected at laterally juxtaposed side edge portions, fill materials located on said interior faces of said panels, a plurality of interior walers extending across and juxtaposed to said interior faces of said panels, and elongated reinforcing strip material secured at one end to said interior walers and extending generally horizontally and rearwardly therefrom and embedded in said fill material behind said interior faces.

24. A retaining wall as claimed in claim 23, said reinforcing strip material comprises a plurality of sections of geogrid having end portions secured to said interior faces of said wall panels.

25. A retaining wall as claimed in claim 24, wherein said reinforcing strip material has end portions secured to said interior waler.

26. A retaining wall as claimed in claim 25, wherein said interior waler is divided into two sections, said end portions of said reinforcing strip material being held between said two sections of said interior waler.

27. A retaining wall as claimed in claim 26, wherein a connector comb securing said reinforcing strip material to both sections of said interior waler.

28. A retaining wall as claimed in claim 27, wherein a lower one of said two sections of said interior waler includes an upwardly opening groove, said connector comb including a plurality of spaced downwardly extending teeth interconnected by a continuous spine, said reinforcing strip material including a plurality of spaced openings juxtaposed to said end portions, said downwardly extending teeth of said connector comb extending through said openings and into said groove to secure said reinforcing strip material to said interior waler.

29. A retaining wall as claimed in claim 28, wherein said downwardly extending teeth are serrated.

30. A retaining wall as claimed in claim 29, wherein an upper one of said two sections of said interior waler includes a downwardly opening groove, said connector comb further including a plurality of teeth extending upwardly into said downwardly opening groove.

31. A retaining wall as claimed in claim 26, wherein said two portions of said interior waler are held together by a U-shaped channel.

32. A retaining wall as claimed in claim 23, further including an exterior waler juxtaposed to said exterior faces of said wall panels and a connector securing said interior waler, said wall panels and said exterior wall to each other.

33. A retaining wall as claimed in claim 32, wherein said interior waler is secured to said exterior waler by a tie rod.

* * * * *